United States Patent [19]

Halsted et al.

[11] 3,967,783

[45] July 6, 1976

[54] SHOWER SPRAY APPARATUS

[75] Inventors: Milton Halsted, Long Beach; Tim M. Uyeda, South San Gabriel, both of Calif.

[73] Assignee: Chicago Specialty Manufacturing Company, Skokie, Ill.

[22] Filed: July 14, 1975

[21] Appl. No.: 595,882

[52] U.S. Cl. ..... 239/102; 239/383; 239/439; 239/447

[51] Int. Cl.[2] ..... B05B 1/08

[58] Field of Search ..... 239/102, 438–441, 239/444, 446, 447, 448, 449, 460, 381–383, 538, 541

[56] References Cited

UNITED STATES PATENTS

| | | | |
|---|---|---|---|
| 2,469,642 | 5/1949 | Grewe | 239/541 |
| 3,514,042 | 5/1970 | Freed | 239/439 X |
| 3,762,648 | 10/1973 | Deines et al. | 239/102 X |
| 3,801,019 | 4/1974 | Trenary et al. | 239/444 X |

*Primary Examiner*—John J. Love
*Attorney, Agent, or Firm*—George J. Netter

[57] ABSTRACT

The shower spray apparatus has a hollow housing with three spray exit openings in a common face, two for normal spray and the third for pulsating spray. Incoming pressurized water is fed into a diverter which includes a slide valve adjustable to proportion the flow of water along either of two paths exclusively, or in a continuous variable range between the two paths. The first path of fluid flow from the slide valve terminates in the two normal spray exit openings, while water flowing along the second flow path drives a turbine and exits via openings in the pulsating outlet. The rotating turbine includes a mask which sequentially covers and uncovers the spray outlet to provide the pulsating output. A knob on the spray apparatus housing is adjustably rotatable to operate a slide valve throughout a full range of adjustment, providing either all normal spray, all pulsating spray or any ratio therebetween. Adjustment of the slide valve adjusts the normal spray outlet to compensate for the change in water supply thereto and thereby provide a substantially uniform spray pattern and spray particle size.

11 Claims, 15 Drawing Figures

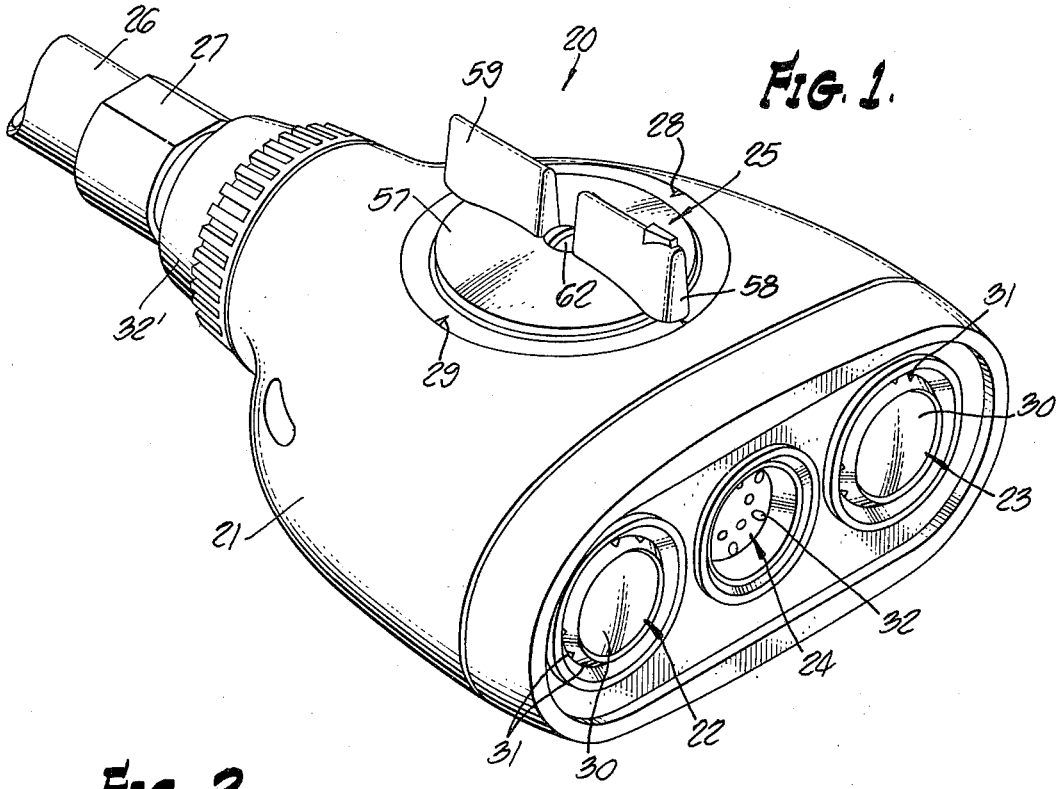
FIG. 1.
FIG. 2.
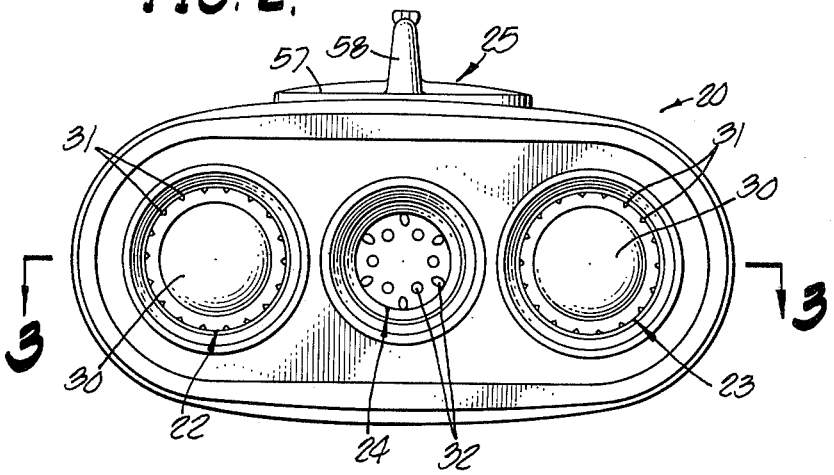
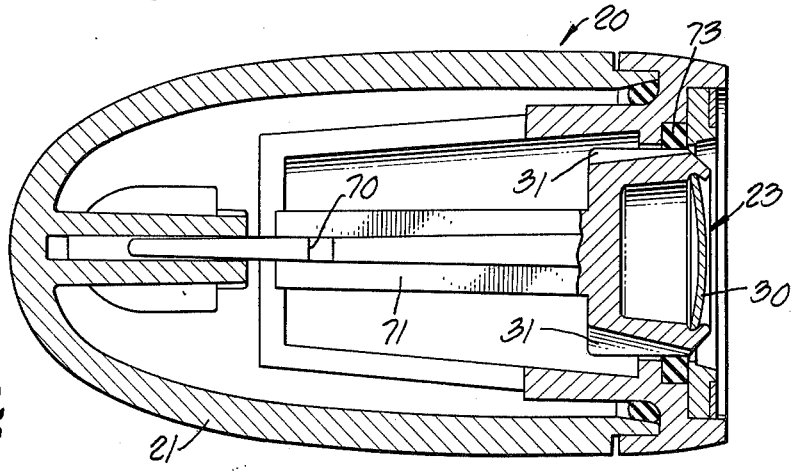
FIG. 4.

FIG. 8.
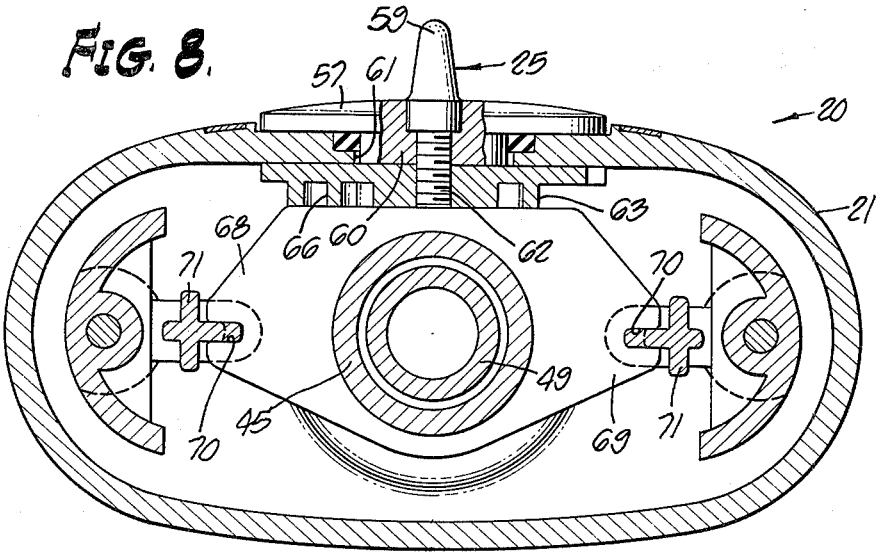
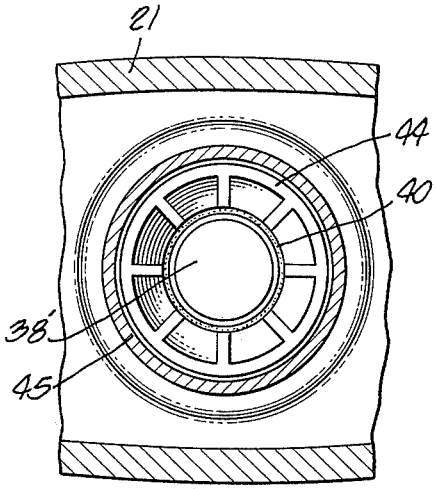
FIG. 9.
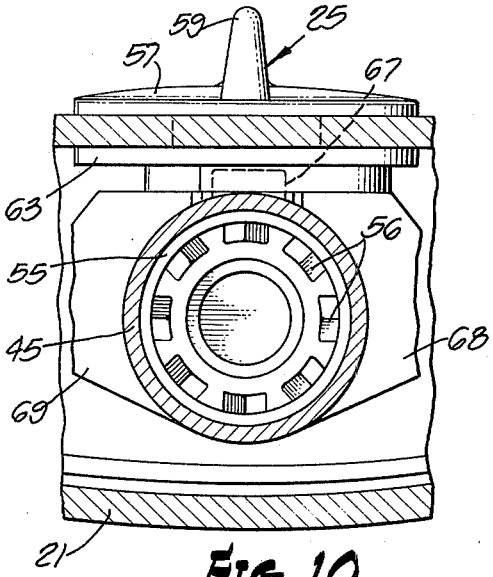
FIG. 10.
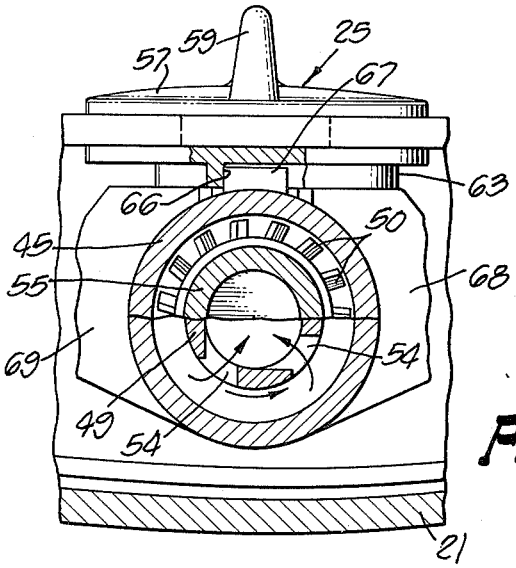
FIG. 11.
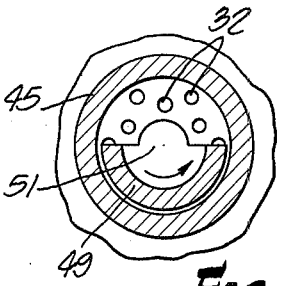
FIG. 12.

SHOWER SPRAY APPARATUS

The present invention relates generally to a shower spray apparatus, and, more particularly, to shower spray apparatus which is selectively adjustable to provide an all pulsating spray, a normal spray or a range of combinations of pulsating and normal spray.

BACKGROUND OF THE INVENTION

For some time, it has been known that a pulsating stream of water has a pleasant effect on a bather and shower spray apparatus with pulsating spray outlets are available. There are, however, other times in which it is desirable to have normal spray in a shower. In certain types of known apparatus the pulsating spray showerhead was not adaptable to provide a non-pulsating spray and therefore conversion to a normal spray required replacement of the shower spray nozzle. In still other versions, where adjustment would provide either pulsating or normal spray, the construction was complex and expensive to manufacture.

SUMMARY OF THE INVENTION

The shower spray apparatus of this invention includes a hollow housing having three spray exit openings in a common face, two for normal spray and the third for pulsating spray. Incoming pressurized water is fed into a diverter which includes a slide valve selectively adjustable to proportion the flow of water along either of two paths exclusively, or in continuous variable range between the two paths. The first path of fluid flow from the slide valve terminates in the two normal spray exit openings, whereas water flowing along the second flow path drives a turbine and exits via openings in the pulsating outlet. The rotating turbine includes a mask which sequentially covers and uncovers the spray outlet to provide the pulsating output. A knob on the spray apparatus housing is adjustably rotatable to operate a slide valve throughout a full range of adjustment, providing either all normal spray, all pulsating spray or any ratio therebetween. In addition, adjustment of the slide valve simultaneously adjusts the normal spray outlet to compensate for the change in water supply thereto and thereby provide a substantially uniform spray pattern and spray particle size.

DESCRIPTION OF THE DRAWINGS

FIG. 1 is a perspective view of the shower spray apparatus of this invention.

FIG. 2 is a front elevational view of the spray apparatus of FIG. 1.

FIG. 4 is a side elevational, sectional view taken along the line 4—4 of FIG. 3.

FIG. 8 is an end elevational, sectional view taken along the line 8—8 in FIG. 5.

FIG. 9 is an end elevational, sectional view taken along the line 9—9 of FIG. 5 through an end of the diverter.

FIG. 10 is a sectional, elevational view taken along substantially the same line as FIG. 9 except viewing into the turbine jet plate.

FIG. 11 is a sectional, elevational view taken along the line 11—11 of FIG. 5 viewing forwardly through the turbine.

FIG. 12 is a sectional, elevational along line 12—12, partially fragmentary view showing the exit plate at which the pulsing output is provided.

DESCRIPTION OF A PREFERRED EMBODIMENT

Figure 3:
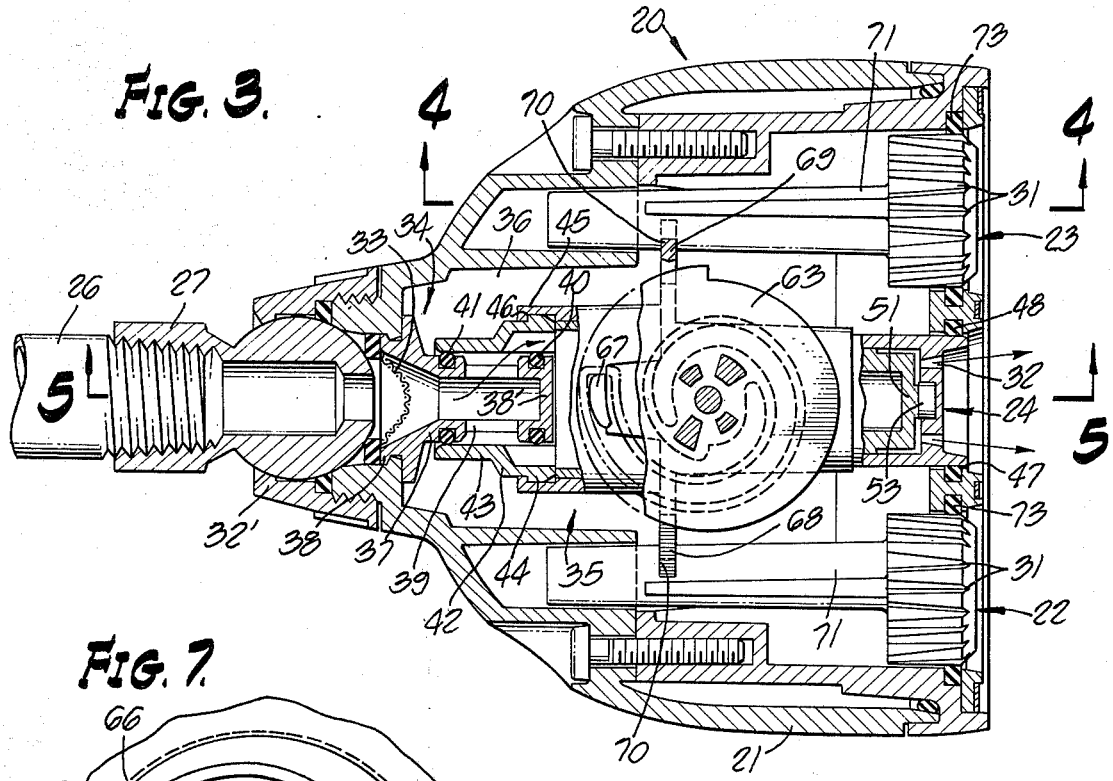
FIG. 3 is a sectional, top plan view taken along the lines 3—3 of FIG. 2.

With reference now to the drawings, and particularly FIG. 1, the showerhead spray apparatus is enumerated as at 20. In its major external elements, it is seen to include a housing 21 having first and second normal spray nozzles 22 and 23, between which is located a pulsating spray outlet 24. A control adjustment knob 25 proportions a selectively variable output of pulsating and/or normal spray. Connection of a pressurized water feed line 26 is accomplished via a conventional threaded fitting 27. More particularly, the knob 25 is adjustable through 360° from a first position 28, at which only a pulsating output is provided, to a second position 29 at which a normal spray is provided with positions therebetween providing a continuous ratio of normal to pulsating spray.

In FIG. 2, each of the normal spray outlets is seen to include a valving member 30 positionable within the associated housing opening to control the amount of normal spray emitted through a plurality of peripheral grooves or openings 31. In a way that will be more particularly described, a pulsating spray output is emitted via openings 32 along a path generally parallel to that of the normal spray.

Figure 5:
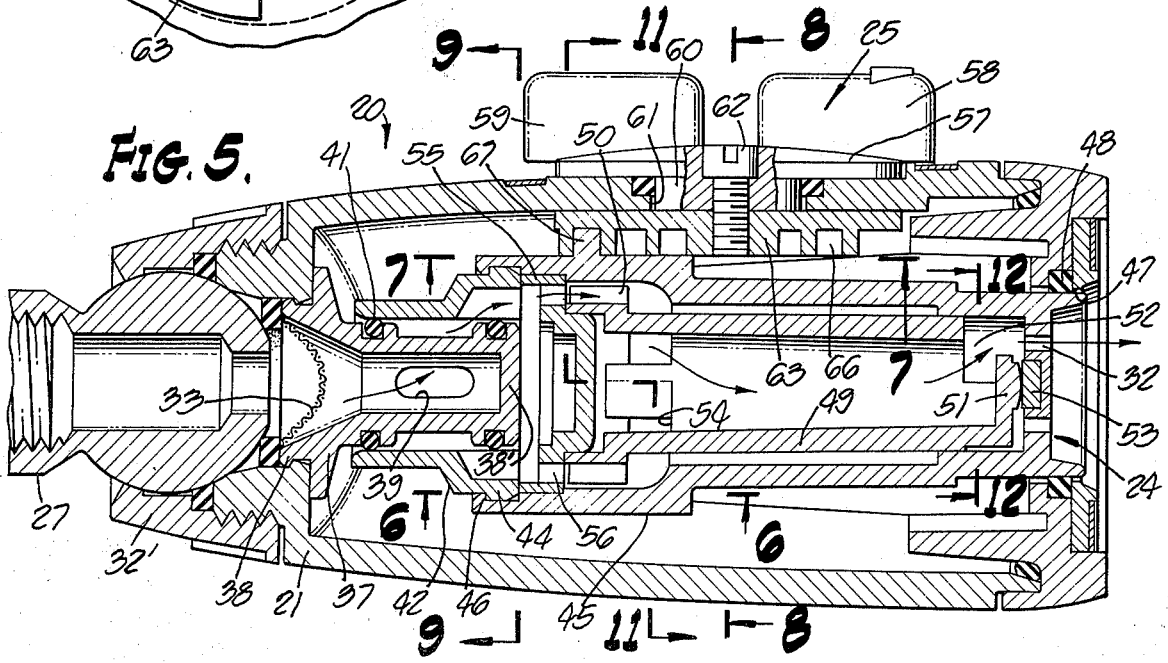
FIG. 5 is a sectional, elevational view taken along substantially the centerline 5—5 of FIG. 3.

Turning to FIGS. 3 and 5, inlet feed line 26 for the pressurized water is threadably received into the fitting 27 which has a ball-like extremity rotatably received within a retainer 32', thereby providing universal movement and positioning for the entire spray apparatus 20. Incoming water through the ball fitting, after passing through a mesh screen or straining means 33, enters a diverter 34 which, in a way that will be more clearly described later herein, is adjustable to direct water in varying amounts to a spray pulse generator 35 and/or otherwise throughout the interior 36 of the housing 21 for emission via the normal spray outlets 22 and 23.

Figure 14:
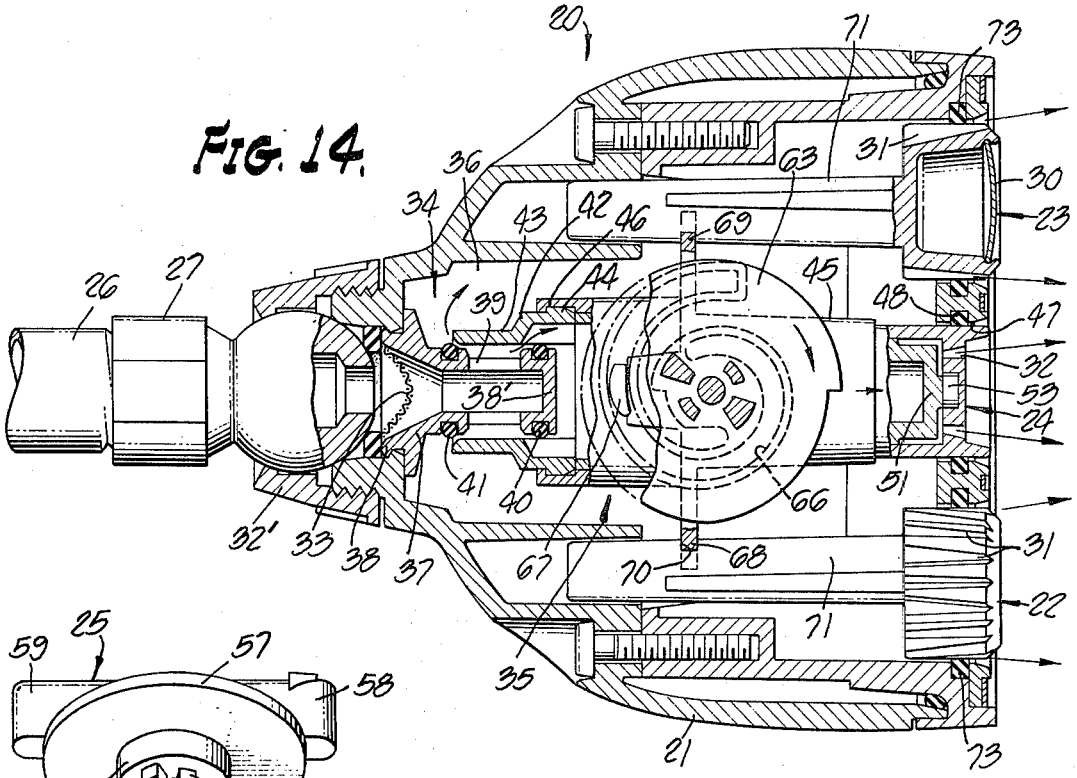
FIGS. 14 and 15 are plan, sectional views of the spray apparatus of this invention showing, respectively, combined pulsating and non-pulsating output, and normal spray output.
Figure 13:
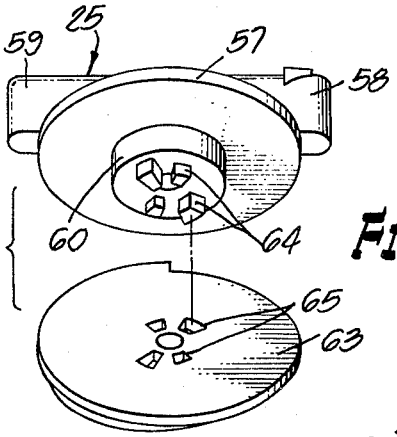
FIG. 13 is an exploded, perspective view of the adjustment knob and associate control plate.
Figure 15:
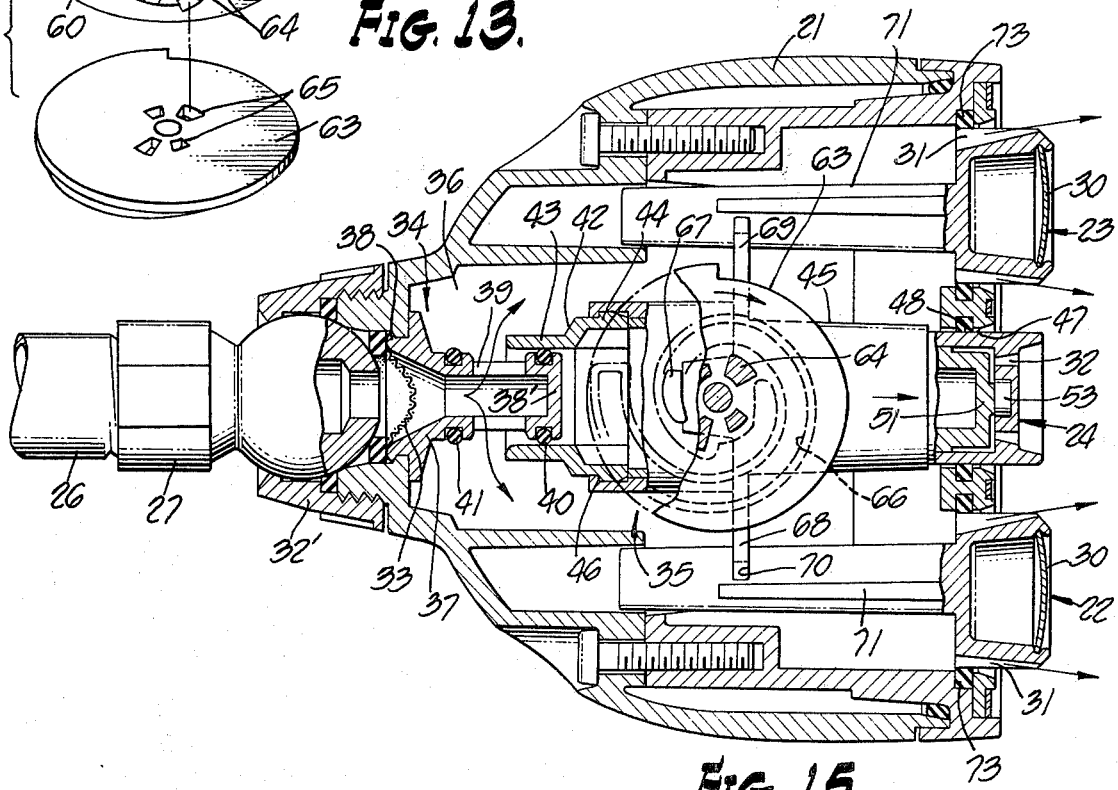

More particularly, the diverter 34 includes a hollow, generally cylindrical body 37 with a flared end portion 38 fittingly received over the screen 33 and the adjacent portions of the housing wall defining the opening through which incoming water is received. The opposite end of the cylindrical body 37 is closed as at 38' whereas the side wall includes a pair of longitudinally extending openings 39. The exterior wall surface of the body 37 has a pair of circumferential grooves for receiving O-rings 40 and 41 therein, at, respectively, the inner end portion and substantially at the line of demarcation between the flared end and the outermost portion of the cylindrical body. A cylindrical valving member 42 has a first diameter portion 43 which is received onto the diverter body 37 in a close fitting relationship preventing water from passing by the O-ring 41 (FIGS. 3 and 5). A second and larger diameter portion 44 of the valving member is connected to the spray pulse generator 35 for movement therewith, in a way that will be described later. It is important to note that the valving member 42 can be positioned over a range from a first extreme (FIG. 3) where all of the incoming water passes through the side wall openings 39 into the pulse generator, a second extreme (FIG. 15) where all of the water is discharged through the same side wall openings into the housing interior 36 to be emitted via the normal spray nozzles 22 and 23, and an intermediate adjustment (FIG. 14) in which water flow is to both the pulse generator and the normal spray nozzles.

Figure 6:
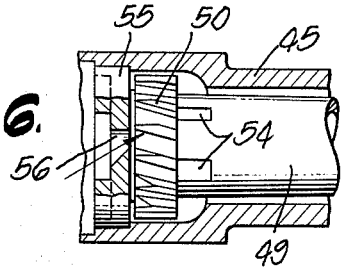
FIG. 6 is a bottom plan, sectional, partially fragmentary view of the turbine taken along the line 6—6 of FIG. 5.

For the ensuing description of the pulse generator 35, reference is particularly made to FIGS. 5 and 6. An elongated tubular housing 45 has one open end received over the flared end 44 of the cylindrical valve member 42 with interfering shoulders locking the two together as at 46. The opposite end of the tubular housing is formed into the pulsating shower outlet 24 which is slidingly received in an accommodating opening 47 in the housing, with an O-ring 48 sealing against leakage of water at the sides thereof.

A rotor 49 includes a hollow, cylindrical body, having at its one end a plurality of generally radially extending blades or vanes 50 formed about its periphery, which vanes are canted with respect to the rotor longitudinal axis as can be seen best in FIG. 6. More particularly, the vanes are arranged parallel to one another about the circumferential periphery of the inner end of the rotor and canted at approximately 15° with respect to the longitudinal axis. The opposite end of the rotor is partially enclosed by a semicircular end wall 51, with the opening 52 providing communication with the rotor interior. When in assembled condition, the end wall 51 abuts against a thrust bearing 53 affixed to the central portion of the wall surface of 24 that lies intermediate the spray pulse exit openings 31. A plurality of openings 54 are formed in the rotor side wall immediately adjacent the vanes.

A jet plate 55 comprises a substantially circular cap which is rotatably received into the end of the rotor housing 49 with its peripheral edge affixed to the inner wall of the housing 45. A plurality of openings 56 are arranged in a circle about the horizontal circular axis and canted such that water passing therethrough is directed against the surface of the blades or vanes in driving relation as can be seen best in FIG. 6 (arrow).

As to operation of the turbine, when the diverter 34 is set to allow water to pass through the valve and into the spray pulse generator, the pressurized water passes through the openings 56 in the jet plate and impinges directly onto the vanes carried by the rotor as in FIG. 6. The reaction of the pressurized water on the blades causes the rotor to rotate and the pressurized water passes back through the openings 54, along the central bore thereof for emission through the space 52. As the rotor rotates and the water is emitted at 52, it will cyclically pass out through different openings 32 during the rotation of the rotor. It is this effect of the water being emitted via different sets of the openings 32 that provides a pulsating spray outlet at 24.

Figure 7:
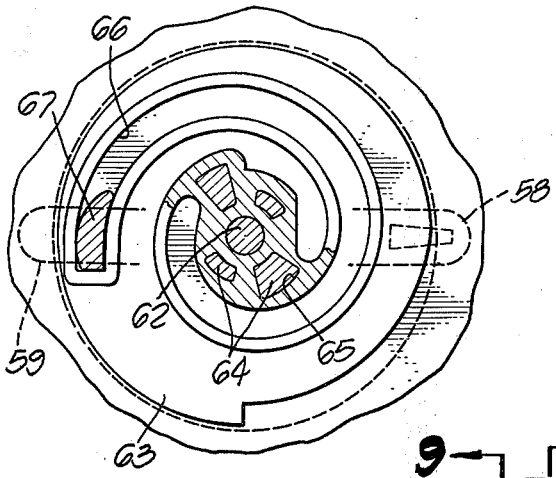
FIG. 7 is a plan sectional, partially fragmentary view of the adjustment cam taken along the line 7—7 of FIG. 5.

For the ensuing description of the manner and means for adjusting the proportion or ratio of pulsating spray to normal spray, reference shall be made simultaneously to FIGS. 3, 5 and 7. The knob 25 has a generally circular, disclike base 57 with a pair of aligned upstanding members 58 and 59 integral therewith, finger manipulation of the latter producing the adjustment movement. A cylindrical shank 60 extends downwardly from 57 through an opening 61 in the housing 21 to connect via a threaded member 62 to an adjustment cam 63. The cam is secured to the shank for rotation therewith by the receipt of projections 64 within appropriately dimensioned openings 65.

The inwardly facing surface of the cam 63 includes a pair of upstanding parallel walls forming a generally helical groove 66 therebetween. This groove is fittingly received onto the extremity of a fingerlike member 67 (FIG. 7) which is integral with the elongated tubular housing 45 (FIG. 5). Accordingly, on rotation of the knob 25, the fingerlike member 67 and the associated tubular housing 45 as well as the interconnected valving member 42 are moved longitudinally within the housing which serves to adjust the flow of water through the openings in the diverter 34 as has already been described.

As can be seen best in FIG. 3, the tubular housing 45 includes a pair of outwardly extending arms 68 and 69 which are received into accommodating openings 70 in the body 71 of the normal spray nozzles 22 and 23. That is, on adjustment of the knob 25 in a forward direction (diverting water in an increasing amount for normal spray emission, the normal spray nozzles are moved outwardly through their respective openings in the housing which as a result of the triangular shaped slots 31 in the periphery of the nozzles allows for a greater quantity flow through the normal spray nozzles. Conversely, this feature is important in that if the amount of water being transferred to the normal spray nozzles was merely increased in quantity flow with the nozzle openings remaining constant, this would thin out the spray prohibitively. However, by providing the grooves 31 with a changing cross-section increasing from the front to the back for each nozzle, the spray pattern and intensity is maintained substantially constant throughout the full range of adjustment. Note is to be taken that an O-ring 73 is received about the normal spray nozzle to prevent leakage therepast except through triangular grooves. Similarly, an O-ring 48 is received into a suitably shaped opening in the wall about the pulsating spray head 24 to prevent the fluid leaking therepast.

What we claim is:

1. Showerhead spray apparatus, comprising:

a hollow housing with an inlet for pressurized water and a wall having first and second spray exit openings therein;

a pulsating spray generator located within said housing and having an outlet end slidably received within said first housing spray exit opening; and slide valve means interconnected with said pulsating spray generator and having parts movable therewith for selectively communicating pressurized water from the inlet with the housing interior, the pulsating spray generator or proportionately therebetween.

2. Showerhead spray apparatus as in claim 1, in which the pulsating spray generator includes a generally cylindrical housing having an end wall with a plurality of openings therein, a rotor and mask driven by pressurized water from the slide valve means which cyclically interrupts water flow through the openings in the end wall.

3. Showerhead spray apparatus as in claim 1, in which the slide valve means includes a first hollow cylinder having an open end, a closed end and an opening in its side wall; said cylinder open end being affixed to the housing in communication with said inlet; a second hollow cylinder telescopingly received over said first cylinder and adjustable longitudinally thereof to pass water outwardly through the first side wall cylinder opening into the housing interior, into the pulsating spray generator, or into both the housing interior and the pulsating spray generator.

4. Showerhead spray apparatus, comprising:

a hollow housing with an inlet for pressurized water and a wall having first and second spray exit openings therein;

a pulsating spray generator located within said housing and having an outlet end slidably received within said first housing spray exit opening for providing a pulsating spray outwardly thereof;

an adjustable nozzle in said second spray exit opening for providing normal spray outwardly thereof; and valve means interconnected with said pulsating spray generator adjustably movable therewith for selectively communicating pressurized water from the inlet with the housing interior, the pulsating spray generator, or continuously proportionate between said housing interior and the pulsating spray generator.

5. Showerhead spray apparatus as in claim 4, in which said nozzle is interconnected for adjustable movement with said valve means and said pulsating spray generator whereby the normal spray outlet is automatically adjusted in accordance with the quantity of water directed into the housing interior by the valve means.

6. Showerhead spray apparatus as in claim 4, in which the pulsating spray generator includes a generally cylindrical housing having an end wall with a plurality of openings therein, and a rotor and mask driven by pressurized water from the valve means which cyclically interrupts water flow through the openings in the end wall to provide a pulsating spray.

7. Showerhead spray apparatus as in claim 4, in which the valve means includes a first hollow member having an open end, a closed end and an opening in a side wall; said member open end being secured to the housing in communication with said inlet; a second hollow member telescopingly related to said first cylinder and adjustable longitudinally thereof to pass water outwardly through the first member side wall opening into the housing interior, in the pulsating spray generator, or into both the housing interior and the pulsating spray generator.

8. Spray apparatus, comprising:

a hollow housing with an inlet for connection to a source of pressurized water and a wall having first and second spray exit openings therein;

a pulsating spray generator located within said housing and having an outlet end slidably received within said first housing spray exit opening for providing a pulsating spray outwardly thereof, said pulsating spray generator including a generally cylindrical housing having an end wall with a plurality of openings therein, and a rotor rotated by pressurized water from the valve means which interrupts water flow through each of the openings in the end wall at least once each rotation to provide a pulsating spray;

an adjustable nozzle in said housing second spray exit opening for providing normal spray outwardly thereof; and valve means interconnected with said pulsating spray generator and said nozzle and adjustably movable therewith for selectively communicating pressurized water from the inlet to the housing interior and said nozzle, the pulsating spray generator, or in continuously proportional amounts between said nozzle and the pulsating spray generator.

9. Showerhead spray apparatus as in claim 8, in which the valve means includes a first hollow tubular member having an open end, a closed end and an opening in a side wall; said member open end being secured to the housing in communication with the pressurized water from said inlet; a second hollow tubular member telescopingly related to said first member, and adjustable longitudinally thereof to pass water outwardly through the first member side wall opening into the housing interior, into the pulsating spray generator, or into both the housing interior and the pulsating spray generator.

10. Showerhead spray apparatus, comprising:

a hollow housing with an inlet for pressurized water and a wall having first and second spray exit openings therein;

a pulsating spray generator located within said housing and having an outlet end movably received within said first housing spray exit opening; and slide valve means interconnected with said pulsating spray generator and having parts movable therewith for selectively communicating pressurized water from the inlet with the housing interior, the pulsating spray generator or proportionately therebetween.

11. Showerhead spray apparatus, comprising:

a hollow housing with an inlet for pressurized water and a wall having first and second spray exit openings therein;

a pulsating spray generator located within said housing and having an outlet end movably received within said first housing spray exit opening for providing a pulsating spray outwardly thereof;

an adjustable nozzle in said second spray exit opening for providing normal spray outwardly thereof; and valve means interconnected with said pulsating spray generator adjustably movable therewith for selectively communicating pressurized water from the inlet with the housing interior, the pulsating spray generator, or continuously proportionate between said housing interior and the pulsating spray generator.

* * * * *